United States Patent [19]

Ketchum

[11] 4,186,922

[45] Feb. 5, 1980

[54] FOOTBALL OFFENSIVE PLAYER TRAINING APPARATUS

[76] Inventor: John L. Ketchum, 3200 SW. 84th Pl., Miami, Fla. 33165

[21] Appl. No.: 899,843

[22] Filed: Apr. 25, 1978

[51] Int. Cl.[2] ..... A63B 67/00

[52] U.S. Cl. ..... 273/55 R

[58] Field of Search ..... 273/55 R, 55 A; 272/116, 135

[56] References Cited

U.S. PATENT DOCUMENTS

| | | | |
|---|---|---|---|
| 2,940,757 | 6/1960 | Britt | 273/55 R |
| 3,329,428 | 7/1967 | Moran | 273/55 R |
| 3,649,016 | 3/1972 | Kelley, Jr. | 273/55 R |
| 3,873,089 | 3/1975 | Krug | 273/55 R |
| 3,889,949 | 6/1975 | Gardner | 273/55 R |

FOREIGN PATENT DOCUMENTS

| | | | |
|---|---|---|---|
| 59259 | 4/1967 | Fed. Rep. of Germany | 273/55 R |

*Primary Examiner*—Richard C. Pinkham
*Assistant Examiner*—T. Brown
*Attorney, Agent, or Firm*—Gustave Miller

[57] ABSTRACT

This device is for use in practice for offensive football players to learn to avoid being tackled by the defensive football players. It consists of a pair of soft spaced apart dummies, simulating the defensive players, the dummies each being suspended by a spring from opposite ends of a bar which in turn is supported on a rotatable shaft at one end of a rod slidably and rotatably supported through a horizontal tube fixed on the top of a supporting stantion, preferably supported in turn on a conventional football training sled. Another rotatable shaft depends from the opposite end of the slidable, rotatable rod. A pulley is secured to each shaft, and a handle is secured to the bottom of the pulley at this opposite end, a cable passing about both pulleys, so that rotation of the pulley with the handle, which is manually controlled by the trainer, correspondingly rotates the other pulley and thus rotates the player simulating dummies. The trainer can thus control the position of the dummies, as well as their angle, so that he can slide the dummies back and forth, and by rotating the handle horizontally, can rotate the dummies slightly, as desired, to change their angle to the approaching offensive player thus teaching him to change his approach, while by rotating the handles vertically slightly, can cause the dummies to tilt slightly, thus giving the trainee practice in running between two tacklers at different angles. Thus the trainee can practice and learn evasive tactics without danger of hurting himself, or of hurting a live defensive player as often happens with the present system of practice with live players of both sides.

9 Claims, 7 Drawing Figures

FOOTBALL OFFENSIVE PLAYER TRAINING APPARATUS

SUMMARY OF THE INVENTION

In football training, it has become traditional to provide tackling and blocking dummies for defensive and offensive teams to strike; however, apparata for training the offensive players to avoid contact are practically unknown, such required training normally being accomplished under live conditions which frequently sustain injuries. In this invention, simulated defensive maneuvering can be brought under the control of the coach.

The coach has a manually controllable pair of handles so connected to the player simulated dummies that he may move dummies in various combinations along the three-dimentional planes.

BACKGROUND OF THIS INVENTION

The purpose of this apparatus is to provide football coaches at all levels with an apparatus that will allow them daily to develop certain sophisticated skills in offensive running backs and offensive linemen. So far as it is presently known, no piece of apparatus exists which will provide this function. The drills alluded to above are presently conducted in a very high risk situation, often resulting in both temporary and sustained injuries to players.

The specific need which the apparatus provides is probably best demonstrated with the following example: "You can't teach that", which is frequently heard on any live TV broadcast of a pro-football game. It is also heard just as frequently at the high school and college level. What the remark generally refers to is a running back's looking for daylight. This desirable ability has always been accepted by coaches as being "instinctive" or "innate" in the athlete. Consequently, if a single piece of equipment can instill or improve upon this skill, a considerable contribution would have been made to the sport.

At the time, the only means by which such training is available to the coach who wishes to attempt to increase skillful running habits in his backs involves "live" drills, and, as mentioned above, such drills often result in players being injured. Even more important to the coaches of young players—junior varsity, etc.—this apparatus provides them with an opportunity to develop skillful running and player confidence prior to placing their young players into the "live" portion of the daily practices.

A modified form of this invention was tested extensively with non-proficient male high school students. The results demonstrated rather conclusively both the role of practice and motivation which tends to operate in the training situation. These subjects were in no way agile or accomplished in running back skills. However, within four days, a significant trend was well established.

Presently, the limits of the apparatus to produce eventual game success will require at least a year or two of observation and reports from various coaches about the country. However, a considerably less effective method was employed in the Fall of 1977, which did produce observable improvements in the running of our high school backs.

Another elusive skill in which coaches are forced to resort to "live" drills is the picking up of stunt-blocking.

The invention is aligned in such a position as to readily simulate a slanting or looping defensive lineman or a firing linebacker. Again, the player is spending extended periods in "live" drills. In other words, coaches are able to spend more time in effective "dummy" work and less time in actual contact work, and still they can produce a more skillful player.

A need exists within the sport of American Football to provide a training apparatus which will greatly facilitate the ultimate efficiency of offensive running backs. Currently, there are neither sufficient apparata nor efficient techniques for developing these skills other than "live" activities which, especially with the young player, must be entered into most judiciously. It is believed that this proposed apparatus would provide daily drills which would promote the desired skills without incurring a high risk to the athlete himself.

The player-simulating dummies are of lightweight, easily compressible material, yieldably suspended on a movable bar connected to a manually operable control bar manipulatable by the coach or trainer. The defensive player-simulating control bar is pivotally suspended at one end of a horizontally movable rod and a coach or trainer manually operable control bar is pivotally suspended at the other end of such rod. Pulleys are provided on the pivoted suspension of the bars and are connected by a cable so that the coach can rotate his pulley and thus rotate the defensive player-simulating dummy carrying pulley. The rod is horizontally movable for a limited distance, in a tube, so that the trainer may move it back or forth as well as rotate the dummies. In addition, the dummies may be tilted by manipulating the trainer-control handle accordingly. Other connecting means, such as a rod and gears at each end may also be used for the coach or trainer to control the dummies.

OBJECTS OF THE INVENTION

It is an object of this invention to provide a football training apparatus for teaching offensive backs to avoid being tackled, and to provide an apparatus not liable to cause injury during practice, as contrasted with using live defensive players with possible injuries to all concerned.

A further object of this invention is to provide tackle simulating dummies under the control of the coach or trainer to give the trainee practice in avoiding being tackled without danger of injury to such trainee or to anyone else.

Yet a further object of this invention is to provide tackling simulating dummies under the control of the coach or trainer so that the trainee may practice avoiding them while the dummies may be moved horizontally, or rotataly, or tiltably, or in one or two or all three such motions simultaneously.

Still a further object of this invention is to provide a mechanical training apparatus for use by the football coach or trainer to give the offensive players practice in avoiding a tackle or in passing between a pair of tacklers, whether they are moving horizontally, or twisting, or are bending over the tackle operation, or are using any one, or any two, or all three tackle motions.

Yet a fuether object of this invention is to enable an offensive football player to practice dodging tacklers without contact which could cause injury to the tackler or the trainee.

A still further object of this invention is to provide an apparatus for training ball carriers in avoiding tacklers with no danger of injury.

Another object of this invention is to provide an apparatus for so training offensive team players to avoid being tackled, which can be used so repeatedly without excessively tiring the player, so that his avoidance of tacklers in actual play becomes almost instinctive.

A further object of this invention is to provide a training apparatus for offense team players that may be mounted wherever convenient, such as on a conventional football training sled, or elsewhere.

Yet a further object of this invention is to provide a three-dimensional apparatus training skill of proficient lateral and forward movements in order to avoid contact and to seek out available openings through which offensive backs can successfully advance the ball.

A still further object of this invention is to provide a football training apparatus which will foester and develop player reactions and forward and lateral movements in offensive backs to learn almost instinctive reaction and avoidance of tacklers.

Another object of this invention is to provide a three-dimensional minimal contact training apparatus which will train offensive players in instantaneous reactions essential to maintaining offensive advantage and initiative during game conditions.

Another object of this invention is to provide a three-dimensional minimal contact training apparatus for offensive players requiring skills of efficient lateral and forward movements in order to avoid contact and to seek out available openings through which offensive backs can successfully advance the ball.

A still further object of this invention is to provide three-dimensional minimal contact training apparatus which will provide offensive linemen with simulated situations of stunt-blocking, in which they will acquire instantaneous reactions in "picking up" the assigned blocking, learning to ignore "drawing" or "sucker" blocks and to block the areas assigned.

The most important object of this invention is to provide an apparatus for training a member of the offense or ball carrying team in how to avoid being tackled by a member of the defensive team, without danger of causing injuries to the players.

A further object of this invention is to provide an apparatus for use in training offensive team players to avoid being tackled, rather than for merely practice in tackling, as shown in the prior art in such U.S. Pat. Nos. as 1,909,461; 2,183,465; 3,424,458; 3,377,064; 3,659,848; 3,637,210; and 3,889,948, amongst others.

BRIEF DESCRIPTION OF THE FIGURES

With the foregoing and other objects in view, this invention comprises the combinations, constructions and arrangement of parts hereinafter set forth, claimed and disclosed in the accompanying drawings, wherein:

DETAILED DESCRIPTION OF THE INVENTION

Figure 4:
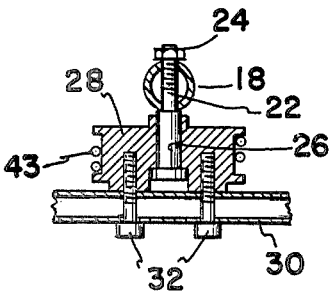
FIG. 4 is a section on line 4—4 of FIG. 1 on an enlarged scale.
Figure 3:
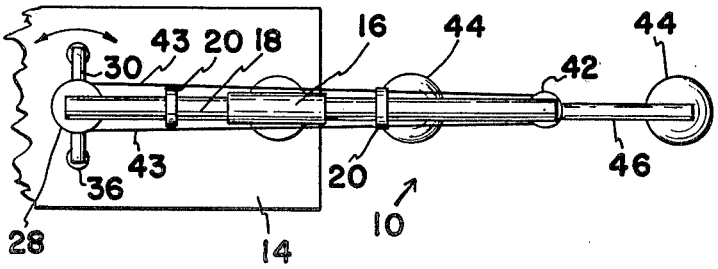
FIG. 3 is a top plan view.

There is shown at 10 the football carrier or lineman training apparatus of this invention wherein a stanchion 12 is suitably mounted in any convenient manner and location. As here shown, it is mounted on a conventional football team training sled 14 for ready portability, although it could also be mounted on or suspended from any suitable permanent or other portable structure. Supported on the stanchion is a horizontal support, here shown as a tube 16, through which is slidably and rotatably supported a rod 18 limited in reciprocation by fixed stops 20 permanently secured on the rod 18.

A trainer manually operable control handle device is secured on one end of rod 18 and it includes a shaft 22 extending therethrough and terminated in a threaded end for a threaded nut 24 to hold it in place. A bushing member 26 on the bottom of shaft 22 provides an axle for a pulley 28 to be controllably rotated thereon by having a bar 30 secured thereto by threaded bolts 32. Manually controllable handles 34 secured at each end of bar 20 have handle grips 36 which are grasped by the coach or trainer, standing on sled 14, for operating them.

At the other end of rod 18 there is simularly supported a shaft 38 having a bushing member 40 on which is rotatably supported another pulley 42 of slightly smaller diameter than the first pulley 28, so that the dummies may be rotated a greater distance than the handle bar 30. The pulleys 28 and 42 are operatively connected by a cable 43 passing about each pulley 28 and 42 so that rotation of pulley 28 will cause a somewhat greater rotation of pulley 42. Secured on pulley 42 is a bar 46 having tackling player-simulating dummies 44 yieldably supported therefrom by a spring 48, here shown as being a tightly wound coil spring 48. The dummies are made of suitable soft material, such as a roll of soft plastic sheeting enclosed within a canvas bag. The dummies 44 are spaced apart a distance simulating the distance a pair of defensive tackling players would be approaching the ball carrier in order to tackle him. Being of soft material and yieldably suspended, the player cannot hurt himself, should he occasionally run into or contact one or both dummies. Obviously, instead of using the cables and pulleys, any other equivalent mechanism may be used to connect the handles to the dummies for operation thereof.

OPERATION OF THE INVENTION

Figure 2:
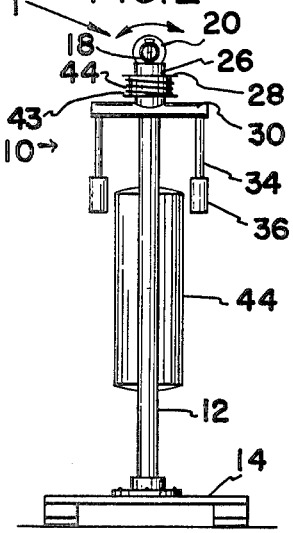
FIG. 2 is an end elevation looking at the left end of FIG. 1.
Figure 1:
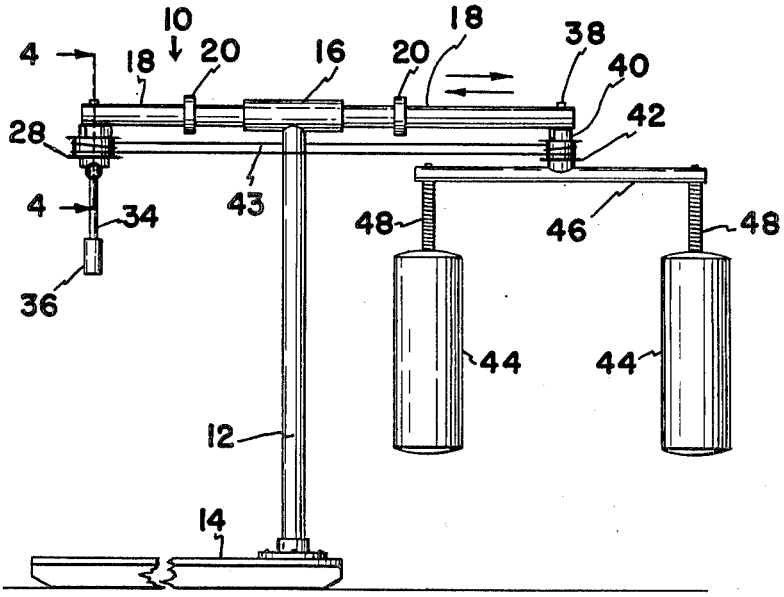
FIG. 1 is a side elevation of the training apparatus of this invention.
Figure 5:
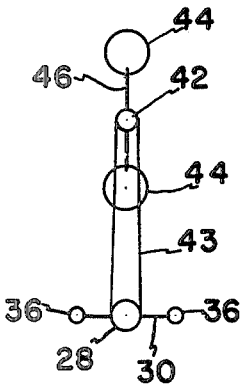
FIG. 5 is a top schematic of FIG. 3.
Figure 6:
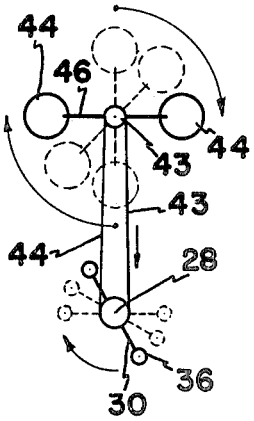
FIG. 6 is a schematic showing the dummies being rotoated clockwise.
Figure 7:
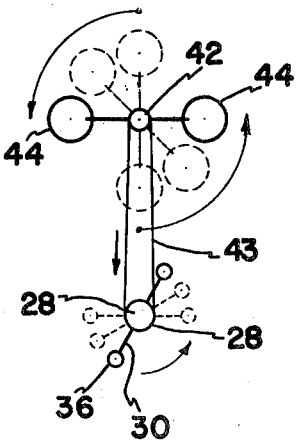
FIG. 7 is a similar view showing counter-clockwise rotation.

In operation, the player trainee is to learn to run between the dummies 44, the trainer operating the handles 34 to cause the dummies 44 to shift their position and thus train the player or trainee to avoid contact therewith. As the player approaches, the coach shifts the position of the dummies 44, sliding the rod 18 back or forth within the limits set by stops 20 so that the player may practice quickly changing his approach in order to go between them without contact. Alternatively, the coach may rotate the dummies 44 a suitable amount, to cause the player to learn to shift his direction of approach to go between them. As the player becomes more proficient, the coach may slightly manually manipulate the handles 34 to rotate the rod 18 slightly as shown at T in FIG. 2 and thus tilt the dummies 44, to provide further training to the player in avoiding contact with the tackler simulating dummies 44.

The coach may manipulate the dummies 44 in any one or two or all three motions as he desired according to the skill of the player as he acquires proficiency in avoiding contact with the player dummies.

ABSTRACT OF THE DRAWING

In the drawing, like numbers refer to like parts and for the purpose of explication, marshalled below are the numbered parts of the improved Offensive Football Player Training Apparatus of this invention.

10 offensive football player training apparatus
12 supporting stanchion
14 conventional football training sled
16 horizontal tube on stanchion 12
18 supporting rod slidable and rotatable through said tube 16
20 limit stops on 18
22 shaft depending from rod 18 at trainer operating end of 18
24 nut on 22
26 pulley bushing at bottom end of shaft 22
28 pulley at trainer end of rod 16
30 handle bar
32 bolts securing handle bar 30 to pulley 28
34 manually operable handles on handle bar 30
36 hand grips on 34
38 shaft for pulley 42
40 bushing for pulley 42
42 pulley for rotating dummies
43 pulley operating cable
44 defensive player simulating dummies
46 supporting bar for dummies 44
48 dummy suspending coil spring Although this invention has been described in considerable detail, such description is intended as illustrative rather than limiting, since the invention may be variously embodied.

Having thus set forth and disclosed the nature of this invention, what is claimed is:

1. A football offensive player training apparatus (10) comprising a substantially horizontally extending rod support (16) circular in cross-section, and having a hollow interior and open ends, a rod (18), said rod supported for sliding motion therethrough and rotary motion about its longitudinal axis thereon, trainer manually operable means (30, 34, 36) mounted on one end of said rod for movement relative thereto, defensive player simulating spaced apart vertically extending dummy means (44) mounted on the other end of said rod for movement about a substantially vertical axis, and means (28, 42, 43) operatively connecting said trainer manually operable means to said defensive player simulating spaced apart dummy means to control said movement of said defensive player simulating spaced apart dummy means, said apparatus being suitably supported for proper training of football players.

2. The apparatus of claim 1, said manually operable means (30, 34, 36) being rotatable about a substantially vertical axis, said defensive player simulating means being horizontally rotatable about said substantially vertical axis, said means connecting said player simulating spaced apart dummy means (44) to said manually operable means being controllable as said manually operable means is moved about said vertical axis by said manually operable means.

3. The apparatus of claim 1, said manually operable means (30, 34, 36) being rotatable about the longitudinal axis of said horizontal rod to tilt said defensive player simulating means in a substantially vertical plane to correspond to said verticle rotation of said manually operable means about said longitudinal axis.

4. The apparatus of claim 1, said manually operable means being rotatable both about a horizontal and a vertical axis, said means connecting said player simulating means to said manually operable means causing said player simulating means to rotate about said vertical axis corresponding to said movement of said manually operable means.

5. The apparatus of claim 4, said connecting means between said trainer manually operable means and said defense player simulating means being a pulley (28, 42) on each said manually operable means and said defensive player simulating means, and a cable (43) connecting said pulley means together for transmitting motion of said trainer manually operable means to said player simulating means.

6. The apparatus of claim 5, said pulley (28) on said manually operable means being of greater circumference than said pulley (42) on said player simulating means.

7. The apparatus of claim 1, said means connecting said manually operable means to said player simulating means being a pulley means (28) secured on said manually operable means and a pulley means (42) secured on said player simulating operating means, and cable means (43) extending from said pulley means of said manually operable means to said pulley means of said player simulating operating means and about both said pulley means for transmitting the motion of said manually operable means to said player simulating means.

8. A football offensive player training apparatus (10) comprising a substantially horizontally extending rod support (16), a rod (18) slidably and rotatably supported on said rod support, said rod having a pair of spaced apart cooperating stop means mounted intermediate its ends, each stop means being further mounted beyond an opposite end of said support rod for limiting the movement of said rod along said rod support, trainer manually operable means (30, 34, 36) mounted on one end of said rod for movement relative thereto, defensive player simulating spaced apart, vertically extending dummy means (44) mounted on the other end of said rod for movement about a substantially vertical axis, and means (28, 42, 43) operatively connecting said trainer manually operable means to said defensive player simulating spaced apart dummy means to control said movement of said defensive player simulating means, said apparatus being supported above a support surface by a substantially vertically extending support post (12).

9. The apparatus of claim 8, said horizontal rod support being a short open-ended tube (16) circular in cross-section, said rod being slidable horizontally and rotatably within said tube.

* * * * *

UNITED STATES PATENT AND TRADEMARK OFFICE

CERTIFICATE OF CORRECTION

PATENT NO. 4,186,922

DATED Feb. 5, 1980

INVENTOR(S) :John L. Ketchum

It is certified that error appears in the above—identified patent and that said Letters Patent is hereby corrected as shown below:

The correct address of the Patentee is:

(76) Inventor: John L. Ketchum, 3200 S.W. 94th Pl.
Miami, Florida 33165

Signed and Sealed this

*Fifteenth* Day of *July 1980*

[SEAL]

*Attest:*

SIDNEY A. DIAMOND

*Attesting Officer*

*Commissioner of Patents and Trademarks*